US007066094B2

(12) United States Patent
Moutsokapas et al.

(10) Patent No.: US 7,066,094 B2
(45) Date of Patent: Jun. 27, 2006

(54) SUPPORTING FRAMEWORK FOR A CRANEWAY

(75) Inventors: Janis Moutsokapas, Monheim (DE); Helge-Eckehard Tempel, Langenfeld (DE)

(73) Assignee: Gottwald Port Technology GmbH, Duesseldorf (DE)

( * ) Notice: Subject to any disclaimer, the term of this patent is extended or adjusted under 35 U.S.C. 154(b) by 278 days.

(21) Appl. No.: 10/181,853

(22) PCT Filed: Jan. 10, 2001

(86) PCT No.: PCT/DE01/00129

§ 371 (c)(1),
(2), (4) Date: Sep. 4, 2002

(87) PCT Pub. No.: WO01/51402

PCT Pub. Date: Jul. 19, 2001

(65) Prior Publication Data

US 2004/0182025 A1 Sep. 23, 2004

(30) Foreign Application Priority Data

Jan. 10, 2000 (EP) ..... 00100445

(51) Int. Cl.
*B61B 1/00* (2006.01)

(52) U.S. Cl. ..... 104/124; 104/123; 104/125; 212/314; 52/299; 52/294; 52/274

(58) Field of Classification Search ..... 52/299, 52/296, 294, 292, 251, 274; 405/229, 231, 405/230; 105/30, 29.1, 29.2, 238, 338, 342, 105/343, 351, 228; 104/124, 125, 89, 123; 212/314

See application file for complete search history.

(56) References Cited

U.S. PATENT DOCUMENTS

| | | | | |
|---|---|---|---|---|
| 3,225,703 | A * | 12/1965 | Lemcke | 104/120 |
| 3,613,600 | A * | 10/1971 | Pettit | 104/91 |
| 4,042,308 | A * | 8/1977 | Freedman | 404/1 |
| 4,200,054 | A * | 4/1980 | Elliston | 114/264 |
| 4,274,336 | A * | 6/1981 | Pater et al. | 104/124 |
| 4,665,829 | A * | 5/1987 | Anderson | 104/124 |
| 4,707,956 | A * | 11/1987 | Sato | 52/167.4 |
| 5,231,931 | A * | 8/1993 | Sauvageot | 104/124 |
| 5,419,398 | A * | 5/1995 | Askestad | 166/355 |
| 5,551,488 | A * | 9/1996 | Gram | 104/282 |

(Continued)

OTHER PUBLICATIONS

BNI Construction Dictionary, BNI, 2001, BNI, 276.*

*Primary Examiner*—Carl D. Friedman
*Assistant Examiner*—Chi Q. Nguyen
(74) *Attorney, Agent, or Firm*—Cohen, Pontani, Lieberman & Pavane

(57) ABSTRACT

A supporting framework for a craneway for at least one crane which travels on at least one track, especially for a bridge crane which travels on two tracks, includes a track carrier elongated in a track direction and having at least one carrier section of reinforced concrete, preferably of pre-stressed concrete. A system of pillars includes reinforced concrete pillars, whose upper ends in each case support the carrier sections via a top component and whose lower ends are in each case anchored in the soil via a base component. An adjustable bearing in the area of the top component and/or of the base component in at least some of the pillars allows adjusting the track carrier according to the desired course of the track.

20 Claims, 7 Drawing Sheets

U.S. PATENT DOCUMENTS 5,946,867 A * 9/1999 Snider et al. ..... 52/167.1
5,992,575 A * 11/1999 Kim ..... 188/38
6,321,657 B1 * 11/2001 Owen ..... 104/119
6,564,516 B1 * 5/2003 Svensson ..... 52/174
6,571,717 B1 * 6/2003 Svensson ..... 104/125
6,665,990 B1 * 12/2003 Cody et al. ..... 52/295

* cited by examiner

FIG.8A
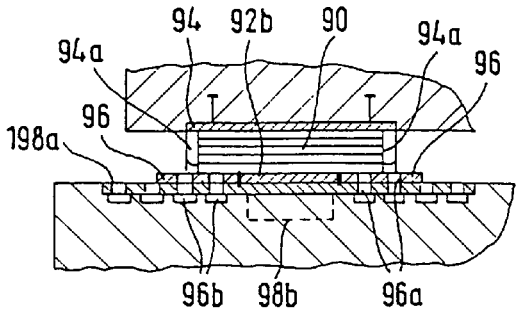
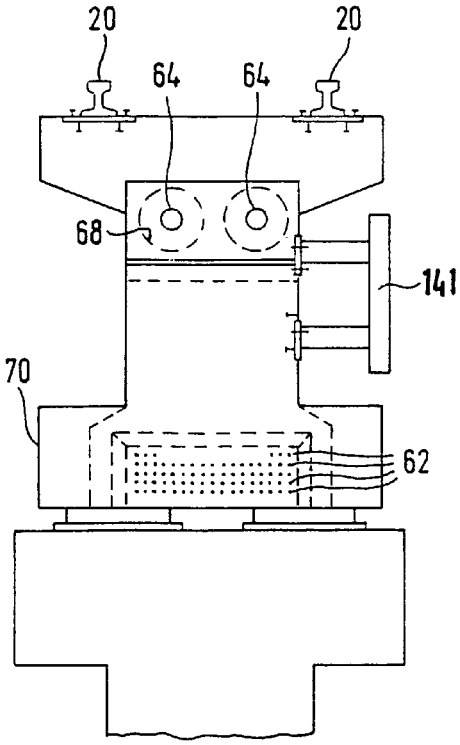
FIG. 11
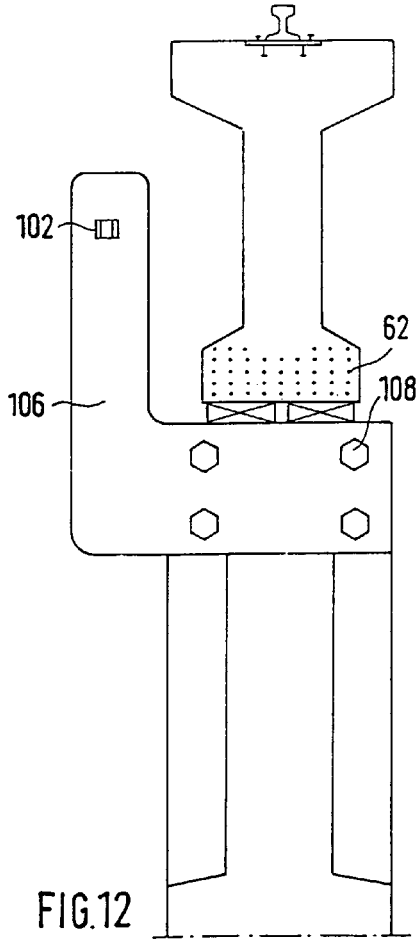
FIG.12

SUPPORTING FRAMEWORK FOR A CRANEWAY

PRIORITY CLAIM

This is a U.S. national stage of application No. PCT/DE01/00129, filed on Jan. 10, 2001. Priority is claimed on that application and on the following application(s): Country: EP, Application No.: 00100445.6, Filed: Jan. 10, 2000 which is the claimed priority document of PCT/DE01/00129.

DESCRIPTION BACKGROUND OF THE INVENTION

1. Field of the Invention

The invention relates to a supporting framework for a craneway for at least one crane which travels on at least one track, in particular for a bridge crane which travels on two tracks. Such craneway systems are primarily used in automated storage operation, for example container stores, casing stores (reinforced concrete prefabrications for lining tunnels), piece-part stores, paper reel stores and so on.

2. Description of the Prior Art

U.S. Pat. No. 3,225,703 discloses a supporting framework for a vehicle, having a track carrier that is elongated in the track direction and made of reinforced concrete, and a system of pillars comprising reinforced concrete supports, whose upper ends in each case support the carrier sections via a top component and whose lower ends are in each case anchored in the soil via a base component.

SUMMARY OF THE INVENTION

The invention is based on the technical problem of providing a supporting framework for a craneway having a high static and dynamic load bearing capacity with low elastic compliance, with the possibility of large supporting widths. At the same time, adjustment of the track which is precise but can be carried out simply and quickly is to be possible.

According to the invention, this problem is achieved by a craneway supporting framework comprising a track carrier which is elongated in the track direction and comprises at least one carrier section of reinforced concrete, preferably of prestressed concrete, a system of pillars comprising reinforced concrete pillars, whose upper ends in each case support the carrier sections via a top component and whose lower ends are in each case anchored in the soil via a base component, and in each case an adjustable bearing in the area of the top component and/or of the base component in at least some of the pillars for adjusting the track carrier according to the desired course of the track.

The concrete construction according to the invention, comprising reinforced concrete pillars and reinforced concrete carrier sections, provides the required rigidity and mechanical load bearing capacity both of the static type (weight forces) and of the dynamic type (crane braking and acceleration operations; wind forces).

It is possible for large supporting widths (for example 20 m) to be achieved, in particular when prestressed concrete carrier sections are used. Given an appropriate height of the pillars (for example 13.5 m), the areas between the pillars can be entered, for example by heavy goods vehicles, in particular container vehicles. The adjustment of the track, which is important for automated storage operation, is exact and largely unchanged during operation, is achieved by the invention in that the track carrier is adjusted appropriately accurately. This adjustment has to be performed only on individual pillars, which considerably reduces the outlay on adjustment as compared with adjusting the track with respect to the track carrier over the entire track length.

Primarily, however, the track considered is not exclusively a metal crane rail, since the latter has been tried and tested under high loads. According to the invention, the crane rail is mounted on the track carrier in such a way that the track is formed by a metal crane rail, preferable made of steel, which is mounted on the track carrier in such a way that thermal expansion and contraction movements of the crane rail relative to the track carrier are permitted. In spite of the mass-dependent different expansion rate and on account of the different thermodynamic characteristics (surface color, surface roughness, geometric surface form) of reinforced concrete and rail steel, the result is that there are no constraints which could lead to critical mechanical loadings, in particular tensile stresses, of the reinforced concrete of the track sections. In order nevertheless to be able to dissipate the braking and acceleration forces exerted on the crane rail by the crane readily into the craneway supporting framework, it is proposed that the crane rail be fixed to the track carrier only at one point, preferably in the area of its longitudinal center, in relation to crane rail movements relative to the track carrier in the track direction. As an alternative to this, the crane rail can also be capable of moving to and fro between end stops at both rail ends, the movement play being such that it never disappears under all conceivable conditions. The holding clamps mentioned below, because of their large number, ensure that the rail is not displaced or displaced only little during normal operation.

Furthermore, it is proposed that the crane rail be mounted on the track carrier via holding clamps which fix the crane rail in the lateral direction and secure it against lifting. This type of fixing firstly permits the substantially free thermally induced expansion and contraction movement of the crane rail relative to the track carrier while largely suppressing the rail movement under normal crane braking and acceleration. Secondly, the exact lateral orientation of the crane rail, which is important for automatic operation, is ensured. In this case, the holding clamps can be provided, via a type of slot and bolt connection to the track carrier, with lateral movement play before the connection is tightened, in order to be able to compensate for fabrication inaccuracies.

In order to impart high stability to the pillars, which, for example, makes it unnecessary to provide crossties for stabilization with respect to bending moments, it is proposed that the base component be anchored in the soil via preferably four deep foundation piles, at best driven piles.

In a first type of connection between base component and pillar, provision is made for an enlarged diameter base section of the pillar to rest on the base component and to be connected to the latter via anchoring elements, preferably forming an adjustable bearing.

With another embodiment, it is proposed that the base component be formed as an encasement for the lower end of the pillar. The adjustable bearing, which can preferably be adjusted in the lateral direction and the vertical direction is at best located in the area of the upper pillar end. The connection between the lower pillar end and the base component anchored in the soil can then be formed particularly simply and at the same time, particularly stably with respect to the forwarding of moments, in particular by means of the already mentioned encasement-like formation of the base component. In addition, the effects of adjusting movements can more easily be overseen. In the possible case of the production of the pillar as a locally cast concrete component, in general the base component will be integrated with the pillar. At least in the case of relatively large crane systems, it is more beneficial in terms of cost to produce the pillar as a fabricated concrete component. The base component can then optionally be a locally cast concrete component or else a fabricated concrete component.

According to a further aspect of the invention, which is intrinsically independent of the aspect described previously, but advantageously cooperates with the latter, a craneway supporting framework is proposed, comprising an elongate track carrier comprising at least one carrier section, a system of pillars, whose upper ends support the longitudinal ends of the carrier sections via a top component, and whose lower ends are in each case anchored in the soil via a base component, and in each case an adjustable bearing in the area of the top components and/or of the base components in at least some of the carrier sections for adjusting the track carrier according to the desired course of the track, a sliding bearing being provided between pillar and track carrier in the area of the top component in at least one of the pillars, this pillar carrying a reference point for a crane location system.

Above all for an automated store, not only is the precise guidance of the respective crane along the correspondingly precisely adjusted tracks important, but also the most precise determination possible of the instantaneous crane location. If the crane location is determined with the aid of a measurement section fixed to the track carrier or track, for example by scanning the crane rails via a measuring wheel, then the precision of the location determination is impaired by the unavoidable thermal expansion and contraction movements of track carrier or crane rail.

According to the invention, the reference point is independent of such movements, since it is provided on a pillar which, additionally, is independent of the thermal track carrier deformations, because of the sliding bearing. This aspect of the invention can also be used in the case of pure steel supporting frameworks even though supporting frameworks with reinforced concrete pillars are preferred because of their higher dimensional stability. The reference point could be formed by an optical element belonging to an optical crane location system, in particular a laser system. In many uses, for example container systems situated in the open air, this can cause problems in the event of fog. One further possibility would be to perform a distance measurement via radio waves, in particular radar waves, but this could likewise be associated with problems, at least in the area of airports or harbors with regular radio traffic. At least in the case of such applications, it is advantageous if the reference point is designed as a fixing point for a scanning element which extends over at least part of the track length. The scanning element therefore extends substantially over the track length, so that direct mechanical scanning of the scanning element is considered, or else scanning acting indirectly over a short distance, for example via induction measuring elements. In a particularly preferred embodiment of the invention, the scanning element is encapsulated, so that it is largely independent of the influences of bad weather.

In a simple and simultaneously robust embodiment of the invention, provision is made for the scanning element to be formed by a chain, in which there engages a gear belonging to a measuring unit connected to the crane. The scanning movement of the gear can in this case be registered by a rotary encoder connected firmly so as to rotate with the gear and forwarded to the crane location device. In order to keep the scanning element always under a pretension which is not too low and not too high, irrespective of the relative position of the two pillars carrying the ends of the scanning element, it is proposed that the end of the scanning element that is remote from the reference point be connected to one of the pillars via a pretensioning element.

It would be conceivable to use a plurality of scanning elements per track, following one other in each case. However, this could result in problems at the transition of the scanning device from one scanning element to the other scanning element. In addition, a central fixing of the scanning element to a reference point of a central support would intrinsically also be conceivable. However, the fitting of the scanning element to both end pillars of the track is particularly preferred. By this means, by using a single scanning element, the entire track length can be monitored. In addition, the scanning of the scanning element is made easier in many cases, since no fixing point for the scanning element interferes with the scanning. A particular cost advantage results when the craneway supporting framework according to the invention is used in relatively large systems having at least two bridge cranes. For this purpose, it is proposed that at least three track carriers are provided, arranged parallel beside one another and spaced apart from one another, with which two bridge cranes are associated, the central track carrier carrying a track for one bridge crane and a further track for the other bridge crane. For n bridge cranes that can be operated independently of one another, only n+1 track carriers are therefore required.

BRIEF DESCRIPTION OF THE DRAWINGS

The invention will be explained in the following text using preferred exemplary embodiments and the drawing, in which:

In the drawings, wherein like reference characters denote similar elements throughout the several views:

FIG. 8A is a side sectional view of the arrangement of FIG. 8 along line VIIIA—VIIIA;

FIG. 11 is a sectional view of the arrangement of FIG. 10 along line XI—XI;

FIG. 12 is a view of an arrangement corresponding to FIG. 11 with an edge track carrier having one crane rail;

DETAILED DESCRIPTION OF THE PRESENTLY PREFERRED EMBODIMENTS

Figure 1:
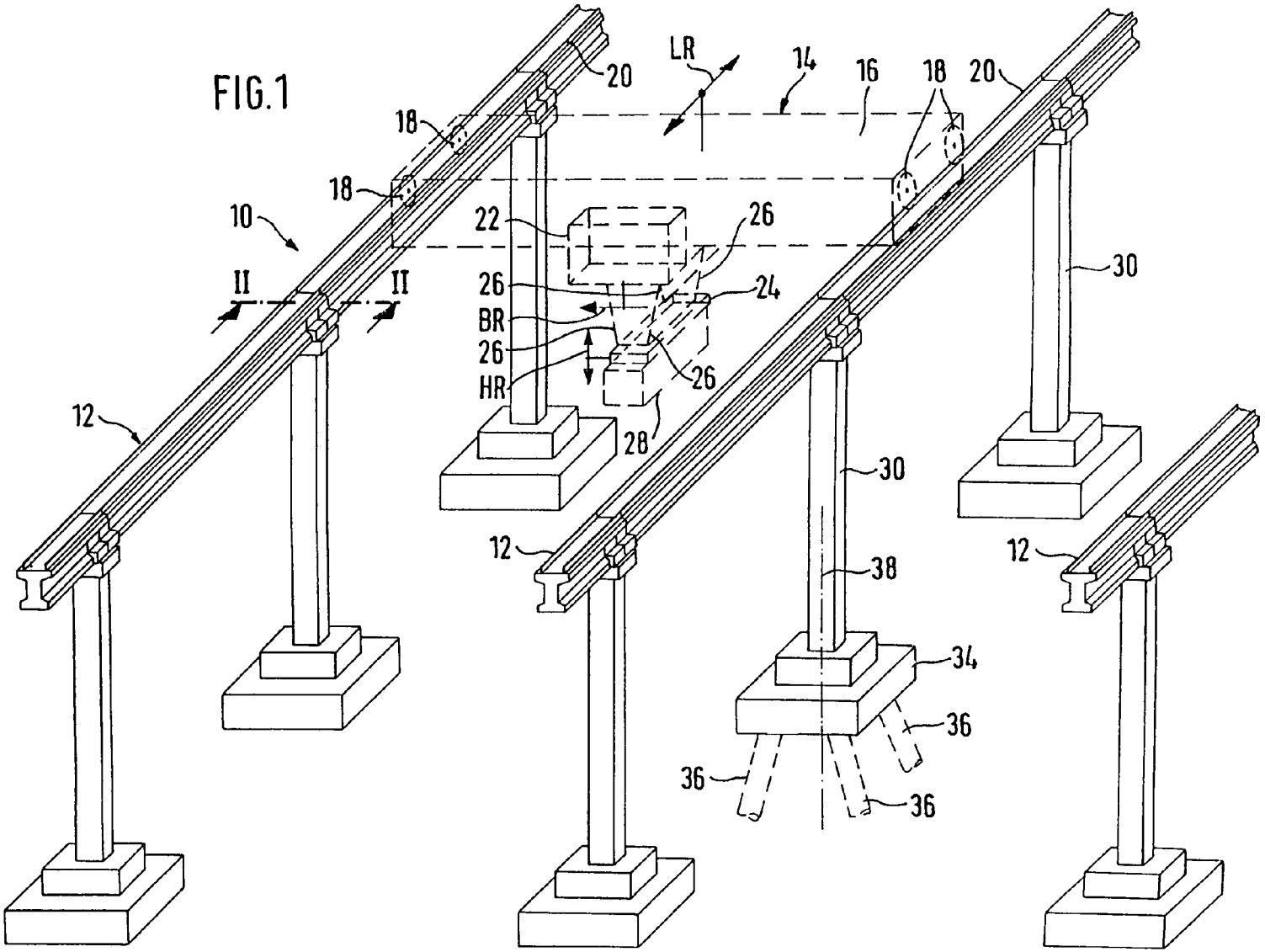
FIG. 1 is an isometric, partially broken illustration of a craneway supporting framework have three track carriers according to an embodiment of the present invention.
Figure 2:
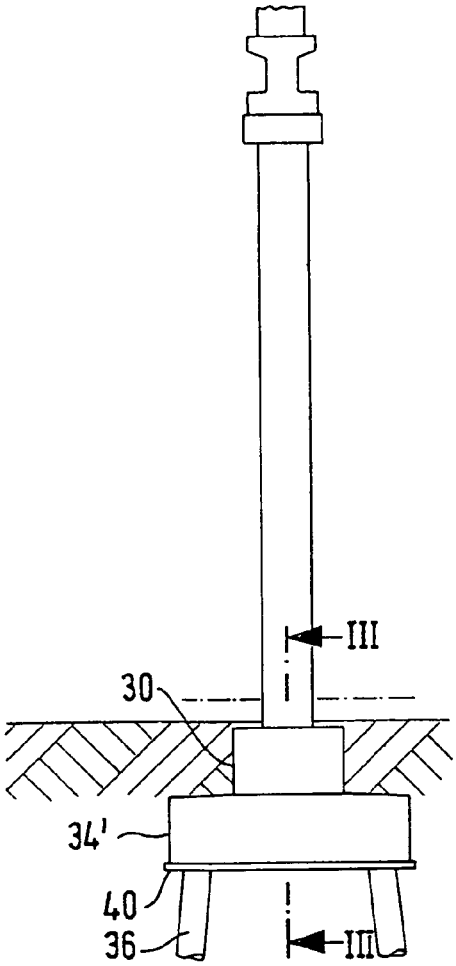
FIG. 2 is a side view of a single pillar along line II—II in FIG. 1.
Figure 3:
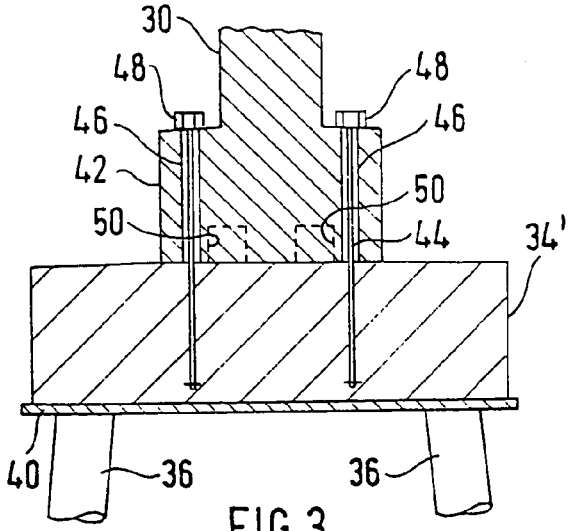
FIG. 3 is an enlarged sectional view of a lower end of a pillar along line III—III in FIG. 2.
Figure 5:
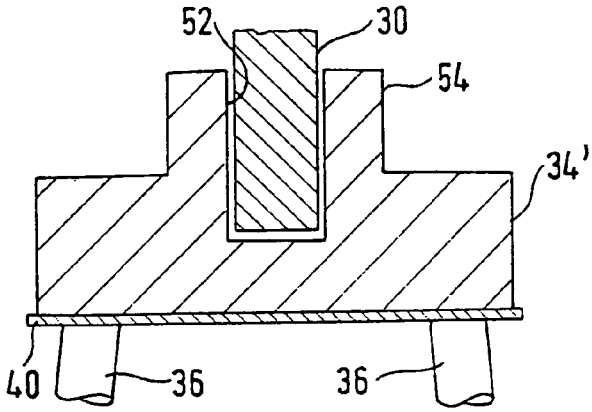
FIG. 5 is an enlarged sectional view of the lower end of the pillar of FIG. 4 along line V—V in FIG. 4.
Figure 4:
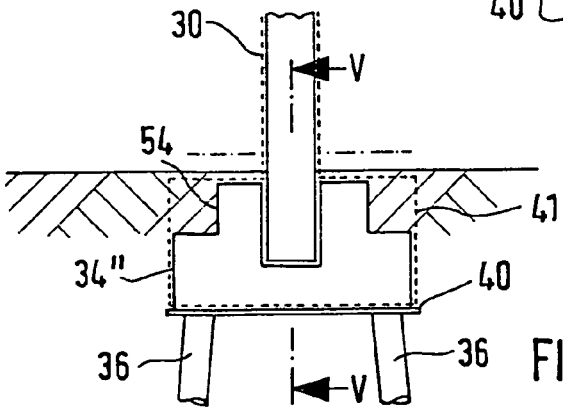
FIG. 4 is a sectional view of a lower end of a pillar according to a further embodiment of the present invention.
Figure 6:
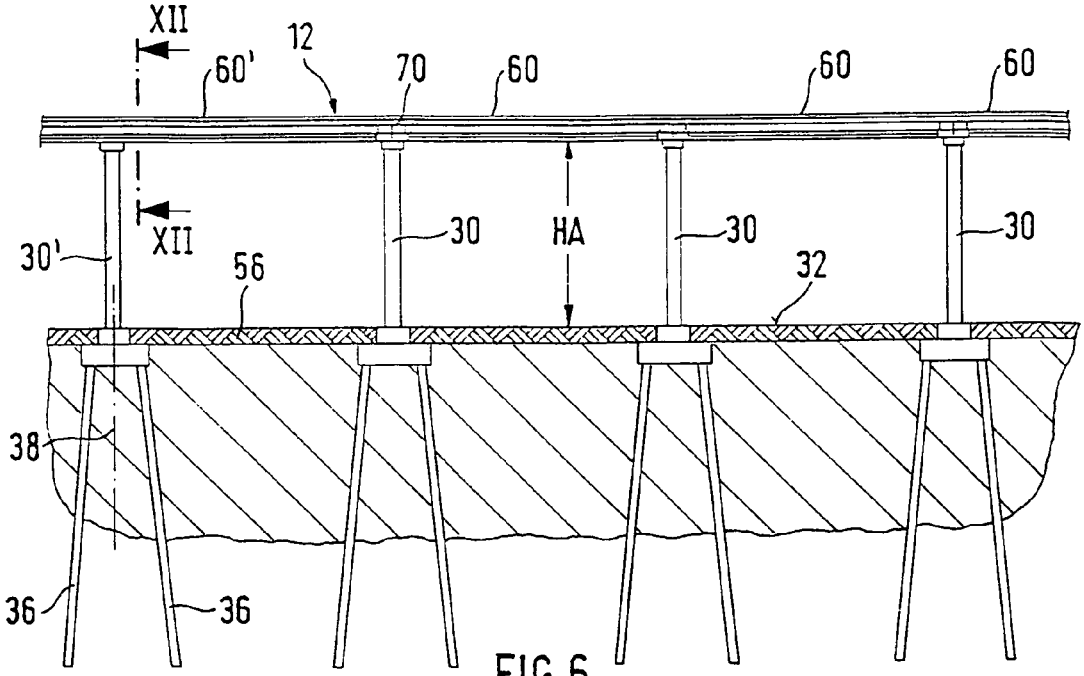
FIG. 6 is a side view of a part of a track carrier supported by a pillar system.

The craneway supporting framework according to the invention is designated generally by 10 in the overview according to FIG. 1. Here, FIG. 1 shows a partial section of a significantly larger overall system comprising a large number of track carriers located parallel and beside one another and having a corresponding large number of bridge cranes that can be operated independently of one another. A bridge crane 14 of this type is indicated roughly schematically in FIG. 1 by an interrupted outline. A bridge 16 belonging to the bridge crane 14 can be moved via two or more rail wheels 18 at the two bridge ends on a crane rail 20 of the respective track carrier 12, to and fro in the track direction (double arrow LR). In turn, a trolley 22 can be moved to and fro in the bridge direction (double arrow BR) on the bridge 16. A load lifting means, for example a spreader, is suspended on the trolley 22 by four load bearing cables 26 and can be raised and lowered iii the vertical direction (double arrow HR). The spreader is used for the connection to the crane load to be loaded, for example a ship's container (ISO container) 28. Each track carrier 12 bears two crane rails 20 in each case for one bridge crane 14 on one side and one bridge crane 14 on the other side. Only in the case of the two outer track carriers 12 is it necessary for only one crane rail 20 to be mounted (see FIG. 12). The craneway supporting framework 10 therefore needs n+1 track carriers 12 for n bridge cranes 14 that can be operated independently of one another. If, in the case of a simplified variant, it is possible to dispense with the bridge cranes 14 being able to operate independently of one another, then only a single track rail per track carrier 12 can also be provided, on which two bridge cranes 14 then run simultaneously. The crane configuration is not bound to the form of the bridge crane. Other crane forms, such as portal cranes, are also conceivable, depending on the type of storage system for which the craneway supporting framework 10 is provided. However, a particular advantage of the invention resides in the fact that the track carriers 12 of the pillar systeiri still to be described and comprising pillars 30 can readily be adapted to a desired running height of the trolley 22, adequate mechanical stability and rigidity being ensured, so that in many cases it is possible to dispense with a complicated portal construction of the crane. The pillars 30 holding the track carriers 12 at a predefined vertical distance HA over the ground surface 32 (see FIG. 6), which can be entered by heavy goods vehicles, are in turn anchored to base components 34. The base components 34, of which a first variant 34' is illustrated in FIGS. 2 and 3 and a second variant 34" is illustrated in FIGS. 4 and 5, are anchored in the soil via deep foundation piles, here in the form of driven piles 36. For each base plate 34, in each case four driven piles 36 are provided, which start in the corner regions of the base component, formed by a substantially square horizontally arranged plate, and which, in relation to the pillar axis 38, run downward and radially outward at an angle. In this way, a construction is obtained which is stable and also dissipates high torques into the soil and is independent of any settling of the adjacent soil, for example because of the container weight.

Instead of driven piles, bored piles can also be used, even if the expenditure on production for driven piles is lower in the event of the soil being suitable for this. The base component can be a fabricated concrete component, even though a locally cast concrete component is preferred, since this makes the production of the connection to the piles easier. For this purpose, it is merely necessary for the base component to be concreted to the upwardly projecting reinforcements of the piles 36. A uniform distribution of pressure to the soil is ensured here by a granular subbase 40, indicated in FIGS. 2 to 5, on the underside of the base component 34. The base component 34 can also be referred to as a pile top plate.

In the variant according to FIGS. 2 and 3, the base component 34' is formed entirely as a square plate, in order to serve as a pad for an enlarged diameter end piece 42 of the pillar 30. Anchoring elements 44, which are cast into the base component 34', can therefore pass through passage openings 46 in the outwardly protruding edge of the end piece 42 and, at their ends protruding upward beyond the end piece 42, can be fixed to the end piece 42 with the aid of fixing means, for example clamping nuts 48.

This type of connection between pillar and base component 34' permits, within certain limits, adjustment of the pillar 30 with respect to the base component 34', specifically both in the horizontal plane and in the vertical direction. In FIG. 3, two inner chambers 50 are indicated, which are used to accommodate hydraulic presses. These permit the pillar 30 to be lifted momentarily with respect to the base component 34', so that the column can be displaced laterally but also in the vertical direction, if necessary to adjust the inclination. After adjustment has been carried out, if necessary with the interposition of adjustment shims for adjusting the height or inclination, the clamping nuts 48 are tightened.

Figure 7:
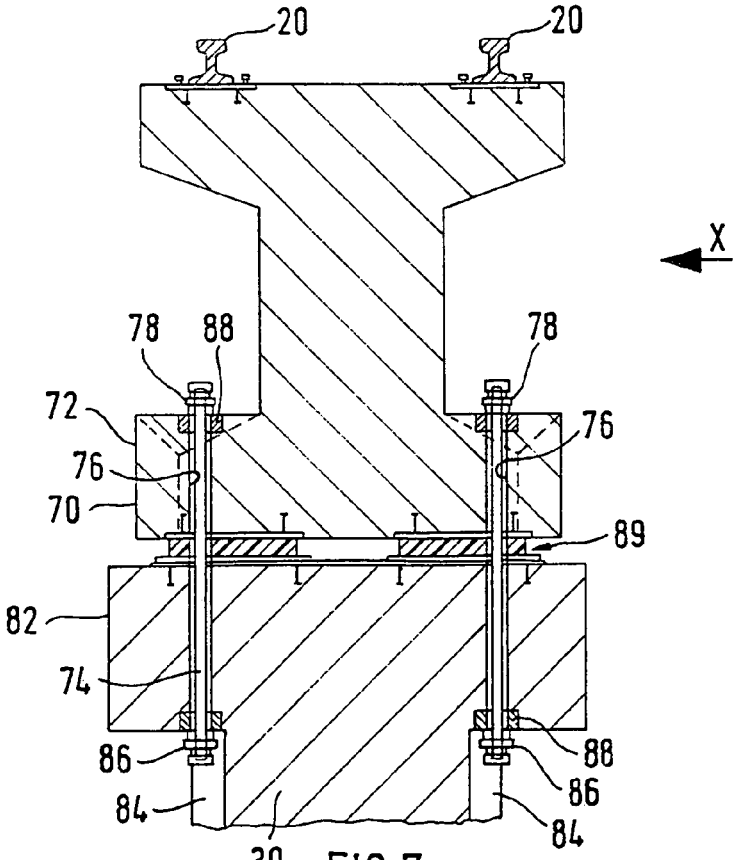
FIG. 7 is a sectional view of a track carrier with the upper end of a pillar along line VII—VII in FIG. 10.
Figure 8:
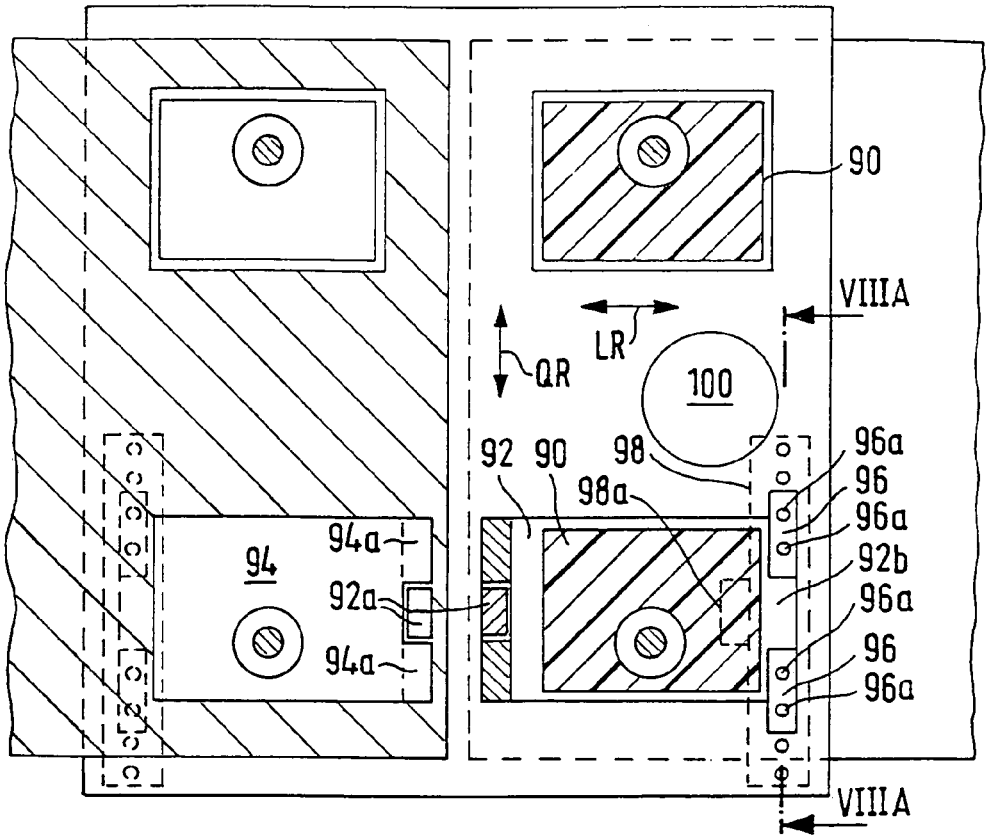
FIG. 8 is a plan view of the components between the track carrier and the upper end of the pillar according to the embodiment of FIG. 10.
Figure 9:
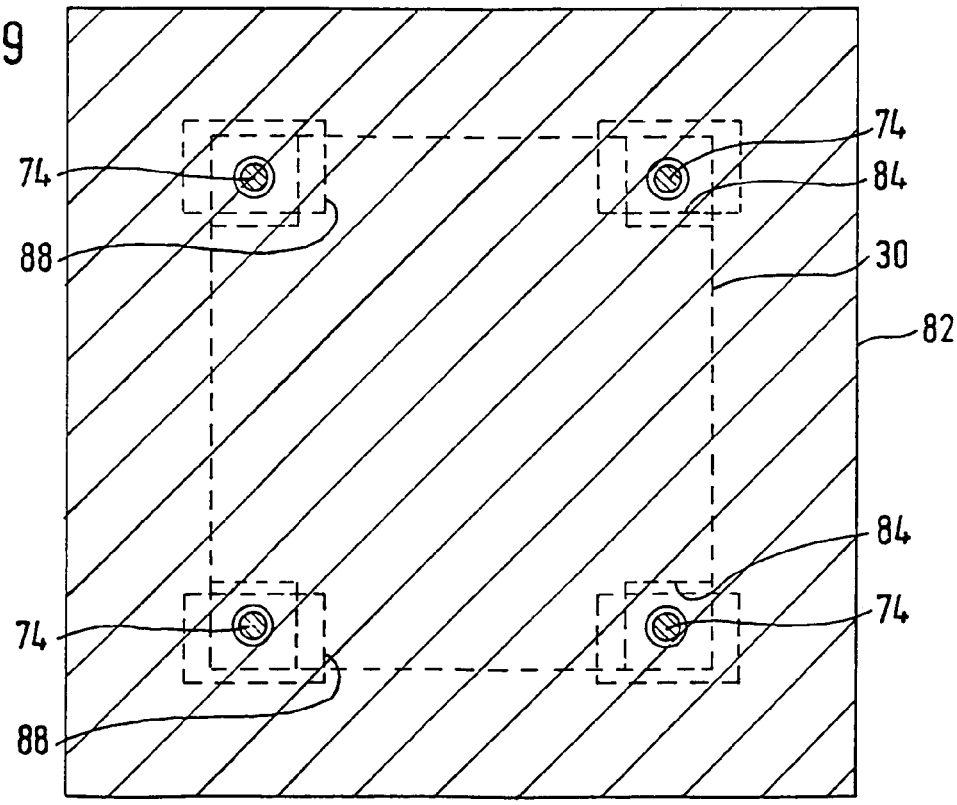
FIG. 9 is section view of the top end of the pillar in FIG. 10 along line IX—IX.
Figure 10:
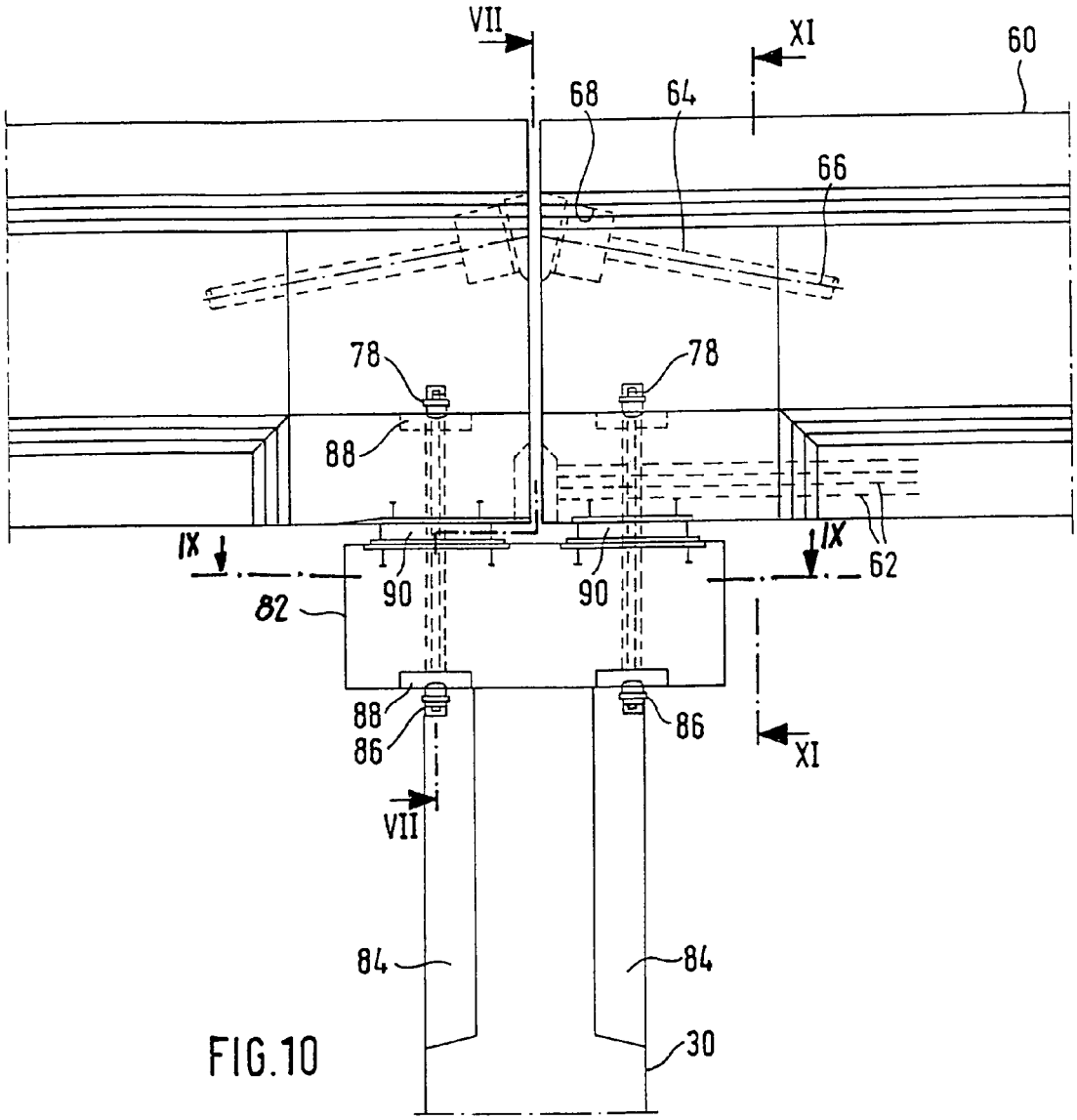
FIG. 10 is a side view of the track carrier and a pillar along direction X in FIG. 7.

In the variant according to FIGS. 4 and 5, no such possible adjustment is provided in the area of the base component 34", specifically because the adjustment is performed at the upper end of the pillar 30. The pillar 30 is plugged with its lower end (without an enlarged diameter end piece) into a receiving opening 52 in the manner of an encasement in the base component 34' and is cast there. In order to enlarge the guide height of the receiving opening 52, the base component, as illustrated in the figures, can be provided with an upwardly projecting collar 54. In FIG. 4, a dotted line 41 indicates the outline of a further variant, in which the pillar 30, as a locally cast concrete component, has been concreted onto the base component 34' (likewise a locally cast concrete component). As FIG. 6 indicates, before the system is commissioned, the area between the pillars 30 is provided with a covering 56 which can be driven on (for example asphalt covering, concrete covering or clinker layer), which ends flush with the upper side of the end piece according to FIGS. 2 and 3 or of the collar 54 according to FIGS. 4 and 5. The track 12 comprises a row of carrier sections 60 with an approximately double-T-shaped cross-sectional shape (see, for example, FIG. 7). These are prestressed concrete components which, apart from slack armoring comprising a large number of stranded cables 62 (ST1 570/5770 of 93 mm each, comprising 7 individual strands) are provided in the area of the lower T head with a prestressed armoring comprising two prestressed stranded cables 66 (ST1 570/1770 of 41 mm each, comprising 5 individual strands). FIG. 10 reveals a stranded cable accommodation channel 64 to accommodate a prestressed stranded cable 66. According to FIG. 11, two such channels 64 are provided for two prestressed stranded cables 66. Starting from an enlarged diameter clamping means chamber 68, open to the front end of the carrier section 60 and between the upper T head and the T base of the double-T cross-sectional shape according to FIG. 11, the two channels run in a downwardly curved line with its vertex in the area of the longitudinal center of the carrier section 60. The carrier section 60 is constructed symmetrically with respect to the longitudinal center. All the carrier sections 60, apart from the last carrier section 60' projecting beyond an end pillar 30', are in each case provided at both ends with a top section 70, which is sectioned in FIGS. 7 and 11 and, as compared with the remaining cross-sectional shape, for example according to FIG. 12, is provided with a flange-like broadening 72 of the lower head of the double-T cross-sectional shape. It is therefore possible, for each head section 70, for two fixing bolts 74 to be pushed through corresponding through holes 76 in the broadening 72 and, at their end projecting upward beyond the broadening 72, to be provided with fixing means in the form of clamping nuts 78. During the passage of the fixing bolts 74, the upper end of the respective column 30 is also provided with an enlarged diameter end piece 82, as shown by FIGS. 7, 9 and 10. However, since the four fixing bolts 74 remain within the cross section of the pillar 30, the pillar 30 is additionally provided in the area of its upper end with edge recesses 84, which can likewise be seen in the aforesaid figures. The upper clamping nuts 78' and lower clamping nuts 86 are in each case supported on plate washers 88 cast into the concrete material (see FIGS. 9 and 10). Between the two mutually facing ends of the carrier sections 60 and the pillar 30 carrying the latter, an armored elastomeric bearing 89 comprising a total of four elastomeric plates 90 is provided, which additionally permits a vertical adjustment and a lateral adjustment (transversely with respect to the longitudinal direction of the carrier sections 60). According to FIG. 8 and FIG. 8*a*, an adjusting plate 92 is provided for this purpose, carries the elastomer plate 90 and, via a stud construction, is coupled to an upper plate 94 fixed to the carrier section in order to transmit forces in the transverse direction QR. For this purpose, the upper plate 94 is provided with two lugs 94*a* bent over downward with the bent edge parallel to the transverse direction QR, between which a lug 92*a* bent upward in the same way and belonging to the adjusting plate 92 engages.

Formed on the edge of the adjusting plate 92 opposite the lug 92*a* is a protrusion 92*b*, which protrudes in the horizontal direction and in so doing engages between two adjusting plates 96. The two adjusting plates 96 are aligned in the transverse direction QR. They can be adjusted in the transverse direction QR, to be specific discontinuously in the exemplary embodiment illustrated. For this purpose, they are each provided with two bolt openings 96*a*, which can be fixed via corresponding adjusting bolts 96b to corresponding bolt openings 98*a* in a base plate 98. The base plate 98 is cast into the outer side of the end piece 82, a lug 98*b* bent downward on the base plate 98 ensuring adequate load bearing capacity in the transverse direction QR. Plate adjustment with a step width falling below the grid dimension of the holes 96*a*, 98*a* is also entirely possible. For this purpose, it is merely necessary to replace the two adjusting plates 96 by adjusting plates with a correspondingly displaced hole pattern. In order to make lateral adjustment easier, a hydraulic press can be inserted between the upper side of the end part 84 of the pillar 30 and the underside of the respective carrier section 60 and then actuated in order to raise the carrier section 60. In FIG. 8, a press stand area 100 is delimited by a circle. The press can also be used for vertical adjustment, the adjustment itself being carried out by replacing the elastomer plate 90 by another elastomer plate with the desired thickness or by interposing or removal of spacer disks.

The lateral adjustment and the vertical adjustment of the ends of the carrier sections 60 can be carried out exactly in such a way that adjustment of the crane rails 20 is rendered superfluous. Since the carrier sections 60 can have large span widths (for example 20 m), the adjustment work is reduced, corresponding to the low number of adjustment points.

Figure 13:
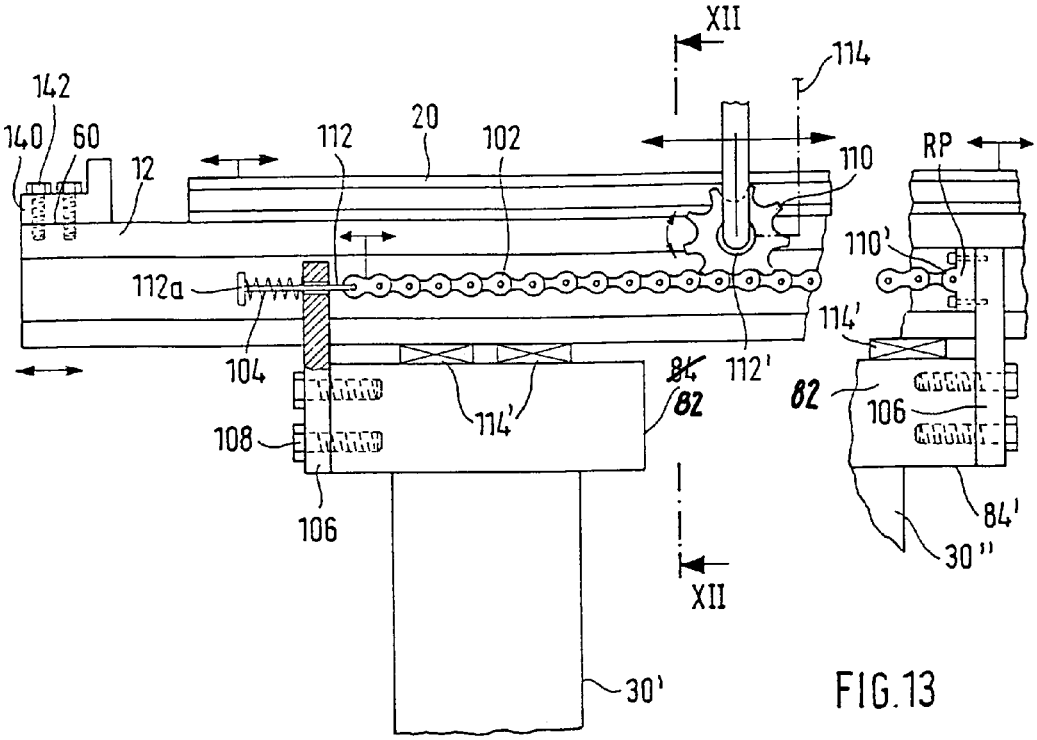
FIG. 13 is a side view of an end pillar and a measuring chain, a measuring unit scanning the measuring chain, and a reference fixing point of the chain.
Figure 14:
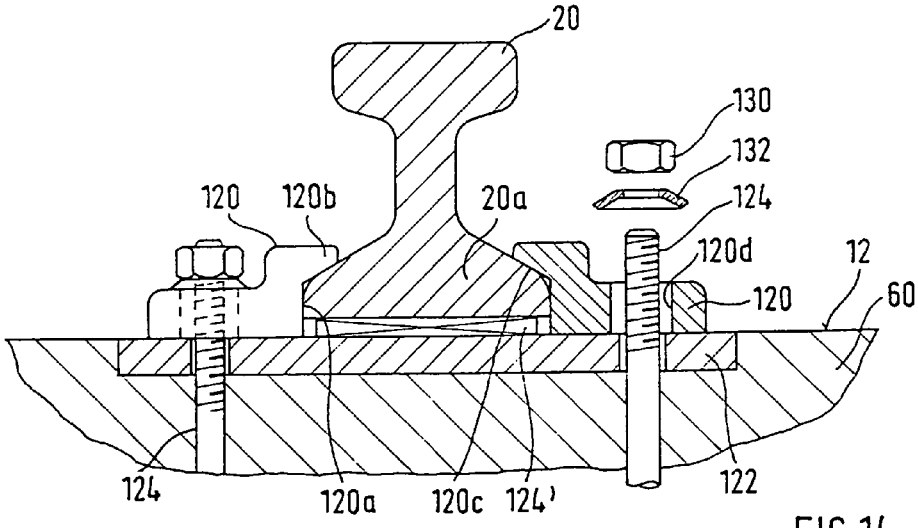
FIG. 14 is a sectional view of a crane rail on the track carrier.

To a limited extent, the above-described bearing arrangement permits relative movements between carrier section 60 and pillar 30 in the running direction LR, which is identical to the carrier longitudinal direction. The stud construction of the interengaging lug-like protrusions 92*a* and 94*a* permits such a movement to a limited extent. The returning force is determined by the shear rigidity of the elastomer plates 90. For automatic operation of the bridge cranes 14 traveling on the craneway supporting framework 10, precise determination of the instantaneous location of the respective bridge crane 14 is of critical importance. According to the invention, the fixed reference point chosen is neither a point on the crane rail 20 nor on the track carrier 12, but a point RP on one of the pillars 30, at best on one of the two end pillars 30. In FIG. 13, this is the right-hand pillar 30". Fixed to it is one end of a chain 102, whose other end is connected to the other end pillar 30' via a pretensioning element (here compression spring 104). For this purpose, in each case an end plate 106 with a substantially L-shaped outline is fixed to those ends of the top components 82 of the two pillars 30' which face away from each other (via fixing bolts 108). The plate 106 on the right in FIG. 13 carries a bearing block 110', which holds the right-hand end of the chain 102 and therefore represents the reference point RP. The end of the chain 102 on the left in FIG. 13 is fixed to a pin 112. The latter passes through the end plate 106 and ends in a pin plate 112*a*. Clamped in between the pin plate 112*a* and the end plate 106 is the compression spring 104 which has already been mentioned and which places the chain 102 under a largely constant tension irrespective of the distance between the end pillars 30', which may change slightly under certain circumstances. Connected to the stranded cables of the bridge cranes whose position is to be registered, is a measuring unit having a gear 110 that engages in the chain 102. The respective angular position of the gear 110 is registered by an angle sensor 112', which forwards the measured angular position via a data line 114, symbolized by a dash-dotted line, to a crane control system (not illustrated). The chain 102 can be encapsulated, in a manner not shown, in order to protect it against the influences of bad weather. In this case, it may be expedient to keep one encapsulation profile open downward, in order that the entry of rainwater is prevented.

In this case, the gear will expediently be caused to engage in the chain from below. In order to decouple the position of the reference point RP entirely from possible thermal movements of the track carrier 12, the track carrier 12 is supported on the top component 84 of the pillar 30" via a sliding bearing 114'. This applies in the same way to the other end pillar 30', in order to keep the chain tension as uniform as possible. The crane rail 20 is mounted on the carrier sections 60 of the track carrier 12 via holding clamps 120. These have in each case a vertical side face 120*a* facing the rail foot 20*a* for the lateral fixing of the rail 20. Furthermore, they engage over the aforesaid rail foot 20*a* with a lug 120*b*, resting with an oblique lug face 120*c* on an oblique face of the rail foot 20*a* or having a slight spacing from the latter. In this way, the rail 20 is prevented from lifting off the track carrier 12. In order to compensate for local unevenness and vertical readjustment which may be required to a certain extent of the rail 20, an intermediate layer 124' is inserted between the rail foot 20*a* and a support plate 122. The plate 122 ends with its upper side flush with the upper side of the carrier section 60. It is penetrated by two anchor bolts 124, which are cast in the carrier section 60. Their upper ends each pass through a passage opening 120d in the two holding clamps 120 on either side of the crane rail 20. The passage opening 120*d* is somewhat overdimensioned, in order to a slight extent still to permit lateral adjusting movements of the holding clamps 120 in order to take account of fabrication and mounting inaccuracies. The holding clamps can be fixed to the carrier section 60 via clamping screws 130 and spring washers 132. The above-described type of fixing permits thermally induced relative movements between the crane rail 20 and the carrier section 60. Because of a certain residual frictional resistance for each pair of clamps and the large number of pairs of clamps for a crane rail 20, however, the overall frictional resistance is generally so high that this predominates over crane forces acting in the rail longitudinal direction (acceleration or braking forces). Should displacement of the crane rail nevertheless occur, then this is limited by stops 140 at both ends of the carrier track (see also FIG. 13). These can be of angular design and rigidly connected to the respective carrier section via fixing screws 142. In this case, the crane rail 20 either rests continuously on the mutually butting plates 122 or discontinuously, with an appropriate distance between the plates 122. In addition, it is conceivable to fix the crane rail 20 to the track carrier 12 at one point, in the preferred region of the longitudinal center of the former, since this does not prevent thermal relative movement of the crane rail 20 with respect to the track carrier 12 on either side of the fixing point. In relation to FIG. 11, the fact is added that the track sections 60 can be fitted laterally with a continuous cable channel 141. Reference should further be made to a particular advantage of the invention, which consists in the fact that because of the deep foundation and the piled guidance of the tracks 12, the craneway supporting framework 10 is substantially unaffected by any possible settling of the storage area between adjacent track carriers 12 arising from the weight of stored goods, in particular containers. According to the invention, settling, which may amount to 15 cm, for example, is filled up again, preferably with clinker. In the case of a rail lying on the ground, on the other hand, the entire area would have to be renovated, since the settling of the ground also entails a change in the position of the rail.

The invention claimed is:

1. A supporting framework of a craneway for a crane which travels on at least one crane rail, said supporting framework comprising:

a track carrier elongated in a track direction and comprising at least one carrier section of reinforced concrete;

a system of pillars comprising a plurality of pillars, each pillar of said plurality of pillars having a top part and a bottom part resting on a base component and comprising reinforced concrete, said top parts supporting said track carrier, and said base components anchored in the ground beneath the supporting framework and supporting said system of pillars;

an adjustable bearing proximate one of said top part and said base component in each one of a subset of said plurality of pillars for adjusting a desired course of said track carrier, wherein said adjustable bearing allows adjustments in at least a vertical direction or a lateral direction relative to said track direction; and a crane rail made from metal and mounted on said track carrier such that thermal expansion and contraction of said crane rail relative to said track carrier is allowed.

2. The supporting framework of claim 1, further comprising an end stop at each rail end of said track carrier, wherein said crane rail is movable along said track direction between said end stops.

3. The supporting framework of claim 1, wherein said crane rail is fixed to said rail carrier at one point with respect to movement along said track direction.

4. The supporting framework of claim 1, further comprising holding clamps for fixing said crane rail in a lateral direction transverse to said rail direction and for preventing said crane rail from lifting from said track carrier.

5. The supporting framework of claim 1, further comprising a plurality of metal plates concreted into said track carrier, said crane rail resting on said plurality of metal plates.

6. The supporting framework of claim 5, further comprising an intermediate layer arranged between said plurality of metal plates and said crane rail.

7. The supporting framework of claim 1, wherein each of said base components is anchored by four foundation piles.

8. The supporting framework of claim 7, wherein said four foundation piles comprise deep driven piles.

9. The supporting framework of claim 7, wherein each of said plurality of pillars comprises an enlarged diameter base section resting on one of said base components and anchoring elements for connecting said base section and said one of said base components, said adjustable bearing comprising said anchoring elements.

10. The supporting framework of claim 7, wherein said base component comprises an encasement for receiving said bottom part of said each pillar.

11. The supporting framework of claim 1, wherein said each pillar comprises one of a local cast concrete component and a fabricated concrete component.

12. The supporting framework of claim 1, wherein said adjustable bearing of at least one of said plurality of pillars comprises a sliding bearing between said top part of said at least one of said plurality of pillars and said track carrier, said at least one of said plurality of pillars carrying a reference point for a crane location system.

13. The supporting framework of claim 12, wherein said crane location system comprises a scanning element extending over at least a portion of said track length, wherein said reference point is a fixing point for said scanning element.

14. The supporting framework of claim 13, wherein said scanning element is encapsulated.

15. A supporting framework of a craneway for a crane which travels on at least one rail, said supporting framework comprising:

a track carrier elongated in a track direction and comprising at least one carrier section of reinforced concrete;

a system of pillars comprising a plurality of pillars, each pillar of said plurality of pillars having a top part and a bottom part resting on a base component and comprising reinforced concrete, said top parts supporting said track carrier, and said base components anchored in the ground beneath the supporting framework and supporting said system of pillars;

an adjustable bearing proximate one of said top part and said base component in each one of a subset of said plurality of pillars for adjusting a desired course of said track carrier, wherein said adjustable bearing of at least one of said plurality of pillars comprises a sliding bearing between said top part of said at least one of said plurality of pillars and said track carrier, said at least one of said plurality of pillars carrying a reference point; and a crane location system comprising:

a scanning element comprising a chain connected to said at least one of said plurality of pillars with said reference point being a fixing point for one end of said chain, said chain extending over at least a portion of said track length: and a measuring unit borne by the crane and comprising a gear, wherein said gear of said measuring unit engages said chain so that said measuring unit can determine a position of the crane relative to the reference point.

16. The supporting framework of claim 15, wherein the other end of said chain is connected to another one of said plurality of pillars by a pretensioning element.

17. The supporting framework of claim 15, wherein said at least one of said plurality of pillars and said another one of said plurality of pillars comprise end pillars of said track carrier.

18. A supporting framework of a craneway for a crane which travels on at least one rail, said supporting framework comprising:

first, second and third track carriers arranged in a parallel arrangement and spaced apart for supporting first and second bridge cranes wherein said second track carrier is a central track carrier and includes a first rail for said first bridge crane and a second rail for said second bridge crane;

a system of pillars comprising a plurality of pillars, each pillar of said plurality of pillars having a top part and a bottom part resting on a base component and comprising reinforced concrete, said top parts supporting said track carriers, and said base components anchored in the ground beneath the supporting framework and supporting said system of pillars; and an adjustable bearing proximate one of said top part and said base component in each one of a subset of said plurality of pillars for adjusting a desired course of a respective one of said track carriers, wherein said adjustable bearing allows adjustments in at least a vertical direction or a lateral direction relative to said track direction.

19. The supporting framework of claim 1, wherein said supporting framework comprises two track carriers for supporting a bridge crane.

20. The supporting framework of claim 1, wherein said at least one carrier section comprises prestressed concrete.

* * * * *